US008960327B2

(12) United States Patent
Stockton

(10) Patent No.: US 8,960,327 B2
(45) Date of Patent: Feb. 24, 2015

(54) SYSTEM FOR MONITORING CORING OPERATIONS

(75) Inventor: Damian J. Stockton, Boya (AU)

(73) Assignee: CoreTrack Ltd, Perth (AU)

( * ) Notice: Subject to any disclaimer, the term of this patent is extended or adjusted under 35 U.S.C. 154(b) by 335 days.

(21) Appl. No.: 13/390,976

(22) PCT Filed: Aug. 16, 2010

(86) PCT No.: PCT/AU2010/001049

§ 371 (c)(1),
(2), (4) Date: Feb. 17, 2012

(87) PCT Pub. No.: WO2011/020141

PCT Pub. Date: Feb. 24, 2011

(65) Prior Publication Data

US 2012/0145457 A1 Jun. 14, 2012

(30) Foreign Application Priority Data

Aug. 19, 2009 (AU) ..... 2009903892

(51) Int. Cl.
*E21B 25/16* (2006.01)
*E21B 25/00* (2006.01)

(52) U.S. Cl.
CPC ..... *E21B 25/00* (2013.01)
USPC ..... 175/44

(58) Field of Classification Search
USPC ..... 175/44, 245, 248, 249
See application file for complete search history.

(56) References Cited

U.S. PATENT DOCUMENTS

| | | | | |
|---|---|---|---|---|
| 4,450,539 | A * | 5/1984 | Bright | 340/853.3 |
| 4,512,423 | A | 4/1985 | Aumann et al. | |
| 4,601,354 | A | 7/1986 | Campbell et al. | |
| 4,638,872 | A | 1/1987 | Park et al. | |
| 5,216,922 | A * | 6/1993 | Gustafson et al. | 73/784 |
| 5,417,295 | A | 5/1995 | Rao et al. | |
| 2007/0061079 | A1 | 3/2007 | Hu | |
| 2008/0156537 | A1 * | 7/2008 | Stockton | 175/58 |

FOREIGN PATENT DOCUMENTS

WO WO-2011020141 2/2011

OTHER PUBLICATIONS

"PCTAU2010001049 Written Opinion", PCTAU2010001049 NPL-1 Sep. 15, 2010 , 1-5.

* cited by examiner

*Primary Examiner* — Nicole Coy
*Assistant Examiner* — Kristyn Hall
(74) *Attorney, Agent, or Firm* — Strategic Patents, P.C.

(57) ABSTRACT

A system (10) for monitoring coring operations including a core sample marker (24) to rest in use on the top of a drilled core sample (14) within a core barrel (16). A cable (26) is connected at a first thereof to the core sample marker (24) and a cable tensioner (30) is provided above the core sample marker (24) to apply tension to the cable (26). A cable movement detector (32) is provided such that as the drilled sample (14) moves up the core barrel (16), the cable tensioner (30) draws the cable (26) up the core barrel (16) and the cable movement detector (32) determines the length of cable (26) drawn up the core barrel (16), thereby providing information regarding the distance traveled by the core sample marker (24).

9 Claims, 2 Drawing Sheets

SYSTEM FOR MONITORING CORING OPERATIONS

RELATED APPLICATIONS

This application is a national stage filing under U.S.C. §371 of published International Application No. PCT/AU2010/001049 filed on Aug. 16, 2010, which is incorporated herein by reference in its entirety. International Application No. PCT/AU2010/001049 was published in English as Publication No. WO 2011/020141. International Application No. PCT/AU2010/001049 claims priority to AU Patent Application 2009903892 filed Aug. 19, 2009, which is incorporated herein by reference in its entirety.

FIELD OF THE INVENTION

The present invention relates to a system for monitoring coring operations.

BACKGROUND TO THE INVENTION

A core barrel assembly is used to obtain a cross sectional sample of a particular geological formation. The core barrel assembly utilizes a specialized core bit attached to a number of outer barrels that are interconnected to make up the desired length. The core bit drills downwardly and has a central opening such that the core bit cuts around a column of the formation that is to be the sample. An inner barrel is provided within the outer barrel for receiving the core sample.

During coring, the core bit is designed to drill around a vertical column of the sample such that the inner barrel passes downwardly around the sample. A known problem that can occur during coring is that the core column is not sufficiently stable and collapses downwardly within the inner barrel. The collapsed core column can create additional friction on the inner surface of the inner barrel resulting in jamming of the core.

Observations of the drilling fluid pressure, the torque and the rate of penetration can provide some indication of whether this core collapse has occurred, however it is not possible to rule out the possibility that changes in these values are the result of some other event (such as a change in the formation). The driller is therefore forced to make a decision that could result in continuing drilling when the core is jammed or stopping drilling when the core is not jammed, both situations resulting in an expensive loss of time and effort.

The present invention relates to a system to be used for monitoring the coring operation to provide information on the capture of the core, thereby reducing the likelihood of an undetected core collapse.

SUMMARY OF THE INVENTION

According to one aspect of the present invention there is provided a system for monitoring coring operations comprising:

a core sample marker to rest in use on the top of a drilled core sample within a core barrel;

a cable connected at a first thereof to the core sample marker;

a cable tensioner located above the core sample marker to apply tension to the cable; and a cable movement detector;

wherein as the drilled sample moves upwardly relative to the core barrel, the cable tensioner draws the cable upwardly relative to the core barrel and the cable movement detector determines the length of cable drawn up, thereby providing information regarding the distance traveled by the core sample marker.

Preferably a spool provided adjacent an upper end of the barrel is connected to a second end of the cable and the cable tensioner applies a rotational force to the spool to wind cable onto the spool as the core sample marker moves upwardly relative to the barrel.

Preferably the cable movement detector engages with the cable adjacent the spool to detect the distance by which the cable has been drawn up by the cable tensioner.

In one embodiment, the cable movement detector includes a wheel around which the cable is wrapped and a sensor to detect rotational movement of the wheel caused by the cable. The wheel is preferably mounted on a housing in which the sensor is located.

In a preferred embodiment, the wheel is provided with one or more magnets around the periphery thereof and sensor is provided in the housing to detect the magnets as they pass the housing such that the sensor can determine the amount of rotational movement of the wheel, thereby providing information on the amount of movement of the cable.

The housing is preferably provided with a transmission system to transmit information regarding the movement of the cable to the surface.

The cable tensioner may be mounted below a flow diverter assembly provided for diverting drilling fluid from within an inner barrel to an outer barrel at the start of coring operations. The flow diverter assembly may be provided below a swivel assembly and safety joint.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
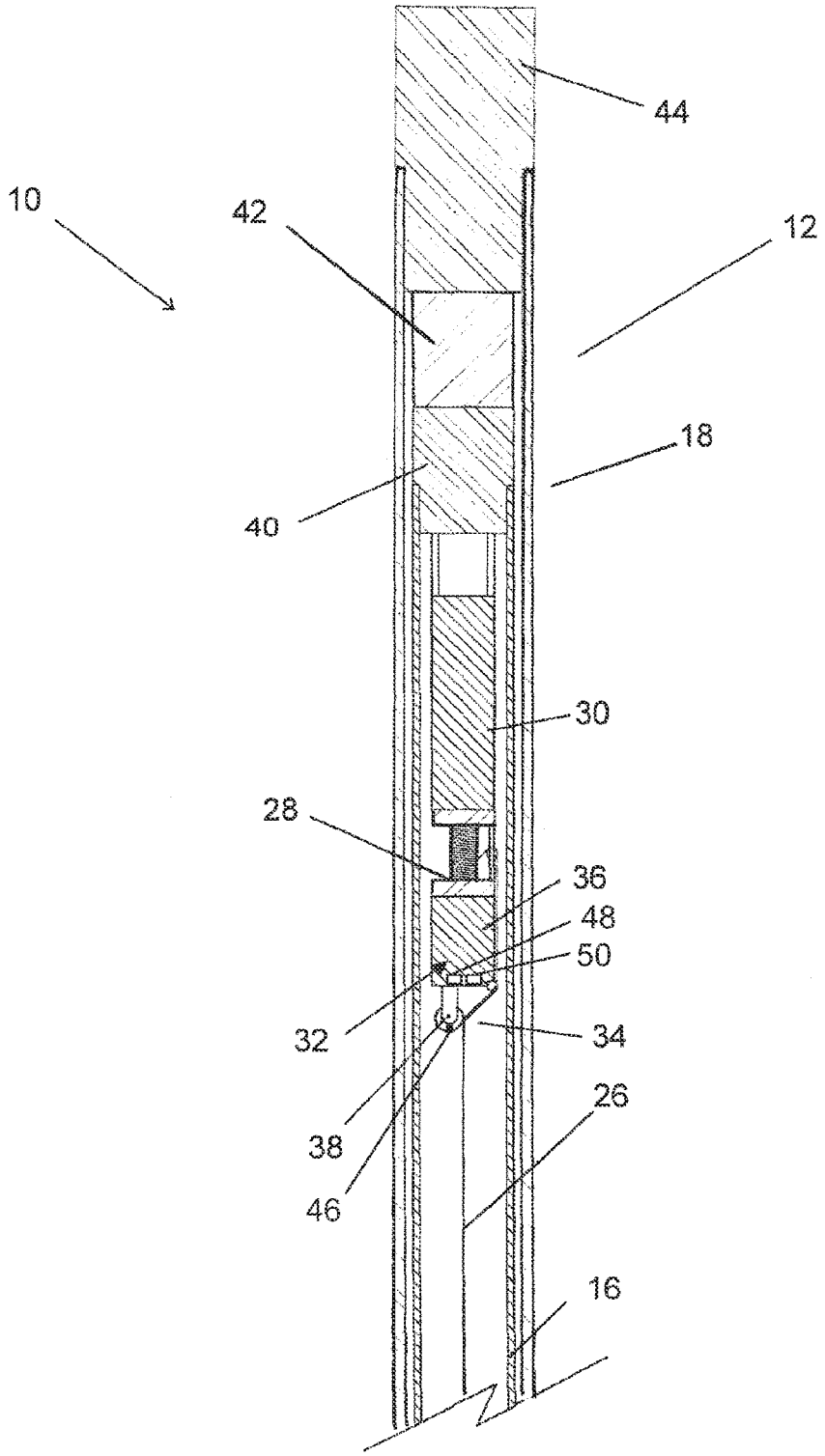
FIG. 1 is a cross sectional view of an upper portion of a coring assembly incorporating the system of the present invention.
Figure 2:
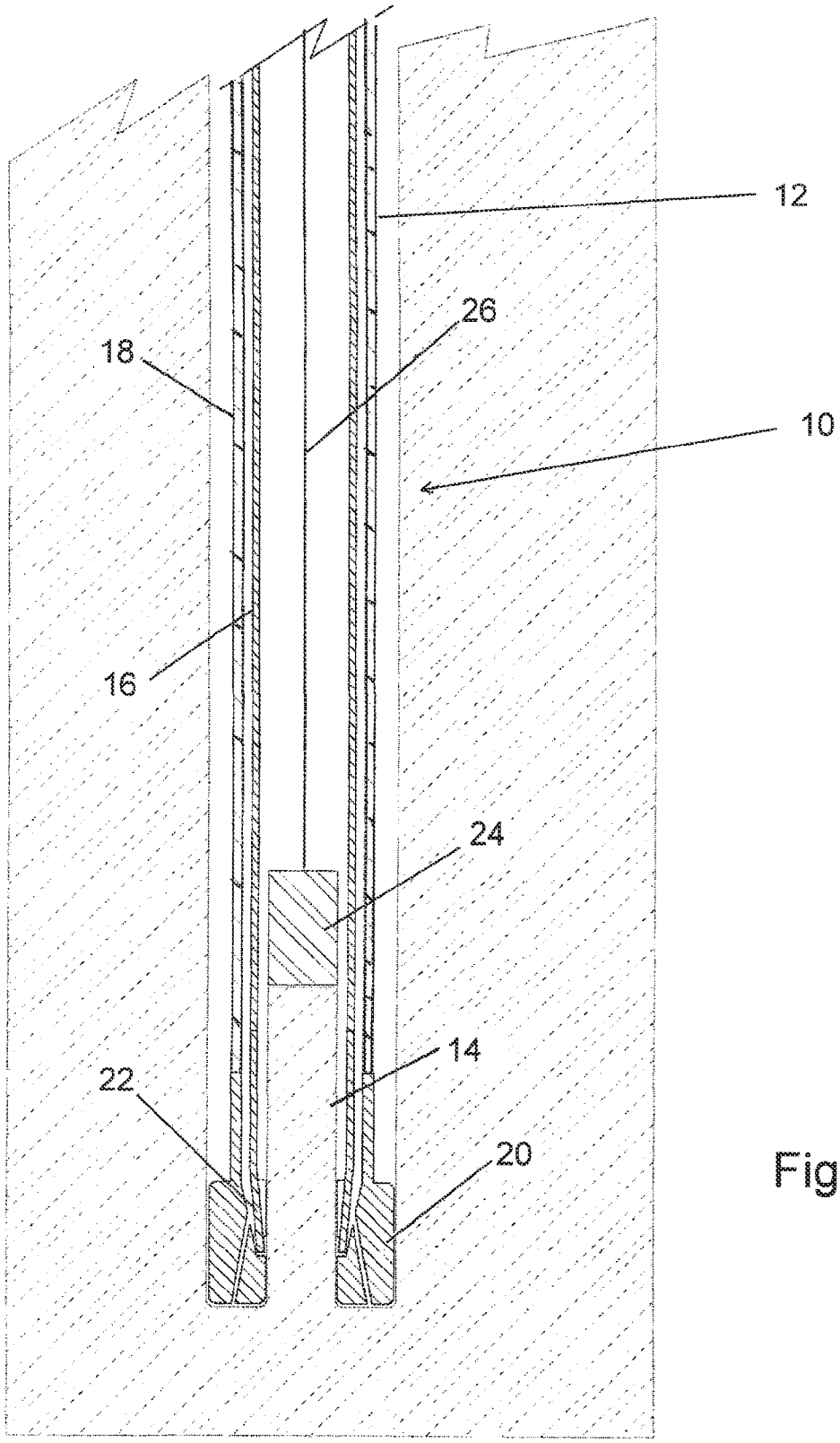
FIG. 2 is a cross sectional view of a lower portion of a coring assembly incorporating the system of the present invention.

Referring to the Figures there is shown a system 10 for monitoring coring operations undertaken by a coring assembly 12 including a core barrel. The core barrel comprises an inner barrel 16 and an outer barrel 18. The coring operations comprise the drilling of a core sample 14 which is received in the inner barrel 16 of the core assembly 12. Drilling fluid is pumped between the inner barrel 16 and the outer barrel 18 in a known manner during the coring procedure. The core sample 14 is drilled from the formation by a core bit 20 and when the coring process is complete a core catcher 22 provided at the lower end of the inner barrel 16 prevents the core sample 14 from falling back out of the inner barrel 16.

The system 10 includes a core sample marker 24 that is arranged in use to rest on top of the drilled core sample 14. The core sample marker 24 may comprise a block of sufficient weight such that the block stays in place on the top of the core sample 14 during the coring operation.

The system 10 includes also a cable 26. A first end of the cable 26 is secured to the core sample marker 24 and the cable 26 extends upwardly from the first end thereof within the inner barrel 16. A second end of the cable 26 is secured around a cable spool 28 provide adjacent an upper end of the inner barrel 16. The cable 26 can be unwound from the spool 28 as the weight descends within the inner barrel 16 and can be wound onto the spool 28 as the weight rises up the inner barrel 16 as the core sample 14 is received in the inner barrel 16.

The system 10 also includes a cable tensioner 30 provided to apply a tension to the cable 26 extending from the spool 28 to the core sample marker 24. In the embodiment shown, the cable tensioner 30 is connected to the spool 28 such that a rotational force is applied to the spool 28 rotating the spool in a direction to wind the cable 26 onto the spool 28. The tension applied is not sufficient to lift the core sample marker 24 but is sufficient to take up any slack in the cable 26 resulting from upward movement of the core sample marker 24 on top of the core sample 14. Therefore, as the core sample 14 and core sample marker 24 rise up the inner barrel 16 during the coring operation, the cable 26 is drawn up the inner barrel 16.

The system 10 is provided with a cable movement detector 32 located adjacent the upper end of the inner barrel 16. The cable movement detector 32 engages with the cable 26 adjacent the spool 28 and is arranged to detect the distance by which the cable 26 has been drawn up the inner barrel 16 by the cable tensioner 30.

In the embodiment shown, the cable movement detector 32 includes a wheel 34 mounted on a housing 36. The wheel 34 is mounted to rotate about an axle 38 and the cable 26 is wrapped around the wheel 34. Movement of the cable 26 within the inner barrel 16 therefore causes rotational movement of the wheel 34 which is detected by the cable movement detector 32.

In the embodiment shown, the wheel 34 is provided with one or more magnets 46 around the periphery thereof and the housing 36 is provided with a sensor 48 to detect each of the magnets 46 as they pass the housing 36. Detection of the magnets 46 thereby gives an indication of the amount of rotational movement of the wheel 34, hence providing information on the distance of movement of the cable 26. The housing 36 may be provided with a transmission system 50 to transmit information regarding the movement of the cable 26 to the surface.

The cable tensioner 30 in the embodiment shown is mounted below a flow diverter assembly 40 provided for diverting drilling fluid from within the inner barrel to the outer barrel at the start of coring operations. The flow diverter assembly 40 is provided below a swivel assembly 42 and safety joint 44.

In use, the core sample marker 24 is lowered through the inner barrel 16 at the commencement of coring operations to rest on top of the core sample 14. As the coring assembly 12 moves downwardly, the core sample 14 and the core sample marker 24 move upwardly relative to the inner barrel 16. The cable 26 is drawn upwardly relative to the inner barrel 16 by the cable tensioner 30. The drawing up of the cable 26, which is wound onto the spool 28, rotates the wheel 34 about which the cable 26 is wrapped. Rotation of the wheel 34 is detected by the cable movement detector 32 and this information is transmitted to the operators of the coring assembly 12.

Information is thereby provided to the operator regarding the distance traveled by the core sample marker 24 relative to the inner barrel 16 and hence the length of core sample 14 drawn into the inner barrel 16. If a comparison indicates that the length of core captured is significantly less than the distance traveled by the coring assembly 12, this indicates that a core collapse may have occurred.

It will be readily apparent to persons skilled in the relevant arts that various modifications and improvements may be made to the foregoing embodiments, in addition to those already described, without departing from the basic inventive concepts of the present invention.

The invention claimed is:

1. A system for monitoring coring operations comprising:
- a core sample marker to rest in use on a top of a drilled core sample within a core barrel;
- a cable connected at a first end thereof to the core sample marker;
- a cable tensioner located above the core sample marker to apply tension to the cable; and
- a cable movement detector;
- wherein as the drilled core sample moves upwardly relative to the core barrel, the cable tensioner draws the cable upwardly relative to the core barrel and the cable movement detector determines the length of cable drawn up, thereby providing information regarding the distance traveled by the core sample marker.

2. A system for monitoring coring operations in accordance with claim 1, wherein a spool provided adjacent an upper end of the barrel is connected to a second end of the cable and the cable tensioner applies a rotational force to the spool to wind cable onto the spool as the core sample marker moves upwardly relative to the barrel.

3. A system for monitoring coring operations in accordance with claim 2, wherein the cable movement detector engages with the cable adjacent the spool to detect the distance by which the cable has been drawn up by the cable tensioner.

4. A system for monitoring coring operations in accordance with claim 3, wherein the cable movement detector includes a wheel and a sensor, wherein the cable is wrapped around the wheel, and wherein the sensor is configured to detect rotational movement of the wheel caused by the cable.

5. A system for monitoring coring operations in accordance with claim 4, wherein the wheel is mounted on a housing in which the sensor is located.

6. A system for monitoring coring operations in accordance with claim 5, wherein the wheel is provided with one or more magnets around the periphery thereof and sensor is provided in the housing to detect the magnets as they pass the housing such that the sensor can determine the amount of rotational movement of the wheel, thereby providing information on the amount of movement of the cable.

7. A system for monitoring coring operations in accordance with claim 6, wherein the housing is provided with a transmission system to transmit information regarding the movement of the cable to the surface.

8. A system for monitoring coring operations in accordance with any one of the preceding claims, wherein the cable tensioner is mounted below a flow diverter assembly provided for diverting drilling fluid from within an inner barrel to an outer barrel at the start of coring operations.

9. A system for monitoring coring operations in accordance with claim 8, wherein the flow diverter assembly is provided below a swivel assembly and safety joint.

* * * * *